US009315744B2

(12) United States Patent
Le Lannic-Dromard et al.

(10) Patent No.: US 9,315,744 B2
(45) Date of Patent: Apr. 19, 2016

(54) FLAKES MANAGEMENT IN HYDROCARBON PROCESSING UNITS

(75) Inventors: Katell Le Lannic-Dromard, Le Havre (FR); Sylvain Prout, La Cerlangue (FR); Gloria Vendrell, Le Havre (FR)

(73) Assignee: TOTAL RAFFINAGE MARKETING, Puteaux (FR)

( * ) Notice: Subject to any disclaimer, the term of this patent is extended or adjusted under 35 U.S.C. 154(b) by 606 days.

(21) Appl. No.: 13/808,437

(22) PCT Filed: Jun. 29, 2011

(86) PCT No.: PCT/EP2011/060875

§ 371 (c)(1),
(2), (4) Date: Mar. 22, 2013

(87) PCT Pub. No.: WO2012/004167

PCT Pub. Date: Jan. 12, 2012

(65) Prior Publication Data

US 2013/0175157 A1 Jul. 11, 2013

(30) Foreign Application Priority Data

Jul. 6, 2010 (EP) ..... 10305746

(51) Int. Cl.

| | |
|---|---|
| ***C10G 65/02*** | (2006.01) |
| ***C10G 49/22*** | (2006.01) |
| ***C10G 49/00*** | (2006.01) |
| ***C10G 49/12*** | (2006.01) |
| ***C10G 67/02*** | (2006.01) |

(52) U.S. Cl.

CPC ..... *C10G 49/22* (2013.01); *C10G 49/00* (2013.01); *C10G 49/12* (2013.01); *C10G 65/02* (2013.01); *C10G 67/02* (2013.01)

(58) Field of Classification Search

CPC ..... C10G 49/22; C10G 49/12; C10G 65/02; C10G 49/00; C10G 67/02

See application file for complete search history.

(56) References Cited

U.S. PATENT DOCUMENTS

| | | | | |
|---|---|---|---|---|
| 4,437,974 | A * | 3/1984 | Minami et al. | 208/404 |
| 4,592,827 | A | 6/1986 | Galiasso et al. | |
| 4,756,821 | A | 7/1988 | Giuliani et al. | |
| 4,770,764 | A | 9/1988 | Ohtake et al. | |
| 4,882,036 | A * | 11/1989 | Eidt et al. | 208/50 |
| 5,298,152 | A * | 3/1994 | Kramer | 208/108 |
| 6,447,671 | B1 | 9/2002 | Morel et al. | |
| 2009/0159505 | A1 | 6/2009 | Da Costa et al. | |

FOREIGN PATENT DOCUMENTS

| | | | |
|---|---|---|---|
| EP | 0 304 682 | A2 | 3/1989 |
| EP | 0 308 195 | A2 | 3/1989 |
| JP | 62-192489 | A | 8/1987 |

(Continued)

OTHER PUBLICATIONS

International Search Report [PCT/ISA'210] for PCT/EP2011/060875, Aug. 3, 2011.

(Continued)

*Primary Examiner* — Prem C Singh
*Assistant Examiner* — Juan Valencia
(74) *Attorney, Agent, or Firm* — Sughrue Mion, PLLC

(57) ABSTRACT

The instant invention discloses a method for the improvement of flakes recovery from hydrocarbon processing units and in particular slurry reactors as well as slurry flakes obtained thereof.

15 Claims, 4 Drawing Sheets

(56) References Cited

FOREIGN PATENT DOCUMENTS

| | | | |
|---|---|---|---|
| JP | 01-101393 | A | 4/1989 |
| JP | 01-131297 | A | 5/1989 |
| JP | 07-090282 | A | 4/1995 |

OTHER PUBLICATIONS

Communication (Notification of Reason(s) for Refusal) dated Jun. 16, 2015, issued by the Japanese Patent Office in related Japanese Patent Application No. 2013-517262.

* cited by examiner

FLAKES MANAGEMENT IN HYDROCARBON PROCESSING UNITS

CROSS REFERENCE TO RELATED APPLICATIONS

This application is a National Stage of International Application No. PCT/EP2011/060875 filed Jun. 29, 2011, claiming priority based on European Patent Application No. 10 305 746.9 filed Jul. 6, 2010, the contents of all of which are incorporated herein by reference in their entirety.

Flakes management in hydrocarbon processing units. The instant invention discloses a method for the improvement of flakes recovery from hydrocarbon processing units and in particular slurry reactors as well as slurry flakes obtained thereof.

Slurry reactors are typically used in hydrocarbon refining processes for the treatment of heavy residues such as conventional vacuum distillation residue (VR) or vacuum visbroken residues (VVR).

Flakes are the final residues from slurry processing. They frequently constitute very heavy residues which contain high boiling point species and most of the metals which were present in initial crude feedstock. Flakes also contain spent slurry catalyst which generally consists of metal chalcogenide species, the metal being typically molybdenum, tungsten or iron.

Typically, solid-liquid separation in a slurry plant occurs on the final vacuum residue (the so-called flakes). This separation is performed by means of filtration. Conventional filtration is difficult because the final vacuum residue is (i) very viscous, and (ii) particles density is close to liquid density to separate.

For all these reasons, flakes are a concern for slurry hydroconversion processes. Flakes are mostly burnt for heat production.

Hydrogen consumption is critical in a slurry plant. Lack of hydrogen always results in poorly converted residues and low quality products.

It has been found that solid-liquid separation can be advantageously carried out before the final vacuum residue is generated. In this respect, lower separation time and better efficiency (such as less plugging) is achieved. Different separation techniques can be used such as filtration, and preferably centrifuge filtration.

A first object of the invention is a method for the separation of solids contained in a solid containing treated hydrocarbon feedstock issued from an industrial unit, wherein an ultimate reactor is fed with an ultimate catalyst, an ultimate hydrocarbon feedstock and an ultimate hydrogen containing gas, and wherein after reaction, the resulting ultimate treated hydrocarbon feedstock undergoes a liquid-solid filtration before a final fractionation is performed.

Advantageously, before reaction and before filtration, a penultimate hydrocarbon feedstock undergoes a penultimate treatment in a penultimate reactor fed with a penultimate catalyst and/or the ultimate catalyst, and a penultimate hydrogen containing gas, to obtain the ultimate hydrocarbon feedstock.

The final fractionation may be a vacuum fractionation or a combination of an atmospheric fractionation followed by a vacuum fractionation.

Advantageously, the resulting ultimate treated hydrocarbon feedstock undergoes flash separation to remove gaseous species before liquid-solid filtration.

Preferably, the industrial unit is a slurry plant.

Advantageously, the filtration allows separating the catalyst from the remaining solid residues contained in the ultimate treated hydrocarbon feedstock.

Preferably, filtration is performed with at least two filters having different porosities so as to discriminate the catalyst from the remaining solid residues.

In such a case, the filter dedicated to discrimination of the catalyst may be back washed with effluents issued from the second filter.

The recovered catalyst may be recycled in the industrial unit or reused in another unit.

According to a further embodiment, separation of solids contained in a solid containing treated hydrocarbon feedstock issued from an industrial unit can be performed using a reactor fed with a catalyst, a hydrocarbon feedstock and a hydrogen containing gas, wherein after reaction, the resulting treated hydrocarbon feedstock undergoes a liquid-solid filtration characterized in that filtration allows separating catalyst, liquid and remaining solids.

Advantageously, filtration technique involves using a first filter which has porosity sufficient to separate large particles of either catalyst or other solids, and using a second filter which has porosity sufficient to separate small particles of respectively either other solids or catalyst.

According to another embodiment, the two filters may be positioned one after the other or disconnected. For instance, with reference to FIG. 1, a first filter may be placed between first reactor 40 and second reactor 50 in order to remove a first catalyst used in reactor 40, while liquid passes through said first filter to the inlet of reactor 50, which is additionally fed with fresh first catalyst and/or second catalyst, while second filter is positioned anywhere downstream reactor 50, depending on easiness of filtration and conversion of the feedstock. First and/or second filter is advantageously a centrifuge filter.

All the above described embodiments of the invention may be combined.

As already mentioned, most of the time, solids including catalyst, coke and sediments remain in the flakes.

Patent documents FR 2594137, to IFP and US 20090159505, to Chevron refer to membrane filtration. However, this technology betters suits to gas-liquid separations. Flakes are high viscosity liquids that are likely to plug the pores of the membrane.

Patent documents CA 2536557 and CA 2579528, both to Kobe refer to solid-liquid separation selectively removing TI (Toluene Insoluble) by light solvent and sedimentation for the solid-liquid separation. Albeit this method is satisfying in terms of plugging, it requires a solvent addition (toluene).

Recoverable solids from slurry flakes are sediments, coke, crushed ore, and fresh or spent catalyst. These solids usually have a particle size ranging from few microns to about 500 microns. These solids account for approximately between 100 ppm to 3% wt of slurry flakes.

The slurry to be treated can contain coke additive. In this case, granulometry ranges from 10 to 1000 microns, preferably from 300 to 500 micron. Coke is usually added when preparing the hydroconversion catalyst. Coke helps obtaining desired catalyst particle size. In other applications, coke is used for the extraction of metals contained in the feedstock (FR 2499584, to Canmet). Coke concentration is set up to 3%, preferably from 1 to 2% wt.

In case of an ore catalyst, granulometry ranges from 10 to 500 microns, preferably from 100 to 200 microns. Concentration is set up to 1% wt.

If a liposoluble or hydrosoluble catalyst precursor is employed, final solid active catalyst concentration in the slurry is set at 1000 ppm, preferably between 100 and 300 ppm. Particle size can range from 5 to 1000 microns. Preferred particle size is set between 5 and 100 microns.

An object of the invention is to provide solid-liquid separation methods while avoiding plugging or solvent addition within a slurry plant.

Solid-liquid separation can be performed using a filter, a membrane or a centrifuge filtration.

Filter can be a simple filter, in case of low solid concentration, or back-washed.

The backwash is performed with a gas or a flush oil (FCC effluent, stream generated by the process . . . ).

Filters mesh will be adjusted according to the solids type.

Filters can be designed with a specific porosity, depending on catalyst and additive type.

For example, in case of an iron-based ore catalytic precursor, filters could be designed as follows:

One first filter with a mesh of 150 microns in order to remove the hydroconversion catalyst after reaction, while liquid and smaller particles flow through it.

A second filter with a smaller mesh (100 microns) in order to remove coke and formed sediments.

Then hydroconversion catalyst which is trapped on the first filter is removed by back-washing with the sediments-free effluent that is collected at the outlet of the second filter.

In case of hydroconversion catalysts having particle size smaller than average sediment/coke, only one filter removes sediments and coke. Otherwise, if hydroconversion catalyst particle size is much smaller than sediments or coke, (e.g. catalyst 20 microns, sediments and coke 100-200 microns) then a first 100 microns filter would retain sediments and coke, while a second 20 microns filter would catch the catalyst.

Centrifuge filtration is particularly well adapted to heavy oils entering or generated by a slurry plant.

The centrifuge device can be a conventional centrifuge, scroll centrifuge or stage of successive centrifuges.

In the case of the described process, no solvent has to be added in order to increase gravity differential between solids and liquid, (especially when filtration occurs before vacuum distillation of feedstock). Difference between effluent and solids density is sufficient for separation (The higher the differential gravity, the more efficient the separation): Average solids density: >1.1. Effluents density: 0.94 to 0.99 depending on conversion rate and efficiency.

An example of suitable centrifuge separation technology includes commercial centrifuge disk-stack or nozzle disk-stack centrifuge technology.

It has been found that flakes valorization can be optimized using a gasification/partial oxidation process (POX).

An another object of the invention is a method of valorization of a metal containing hydrocarbon feedstock issued from an industrial unit using a metal containing catalyst, wherein spent metal containing catalyst and/or metal containing residual hydrocarbon feedstock are collected using any of the separation methods according to the invention, and treated to produce carbon monoxide, hydrogen and a metal containing residue.

Such treatment is preferably a calcination, most preferably performed under partial oxidation conditions.

Industrial unit is advantageously a slurry plant, the metal containing hydrocarbon feedstock being preferably issued from a reactor of an industrial unit Gasification/partial oxidation process results in metal recovery (catalyst and metals contained in the feedstock) and hydrogen generation.

Potential savings for catalytic metal recovery can be estimated. For example, hydroconversion process requires 800 kg/Mo per day in a 25000 barrels/day unit operating at 200 ppm molybdenum based catalyst concentration.

Gasification/partial oxidation allows catalyst recovery together with residual Nickel and Vanadium which are contained in the feedstock.

Metal concentration in vacuum residues varies from 5 to 150 ppm for Ni and from 20 to 400 ppm for Vanadium. Obviously, the most interesting feedstocks to valorize in slurry hydroconversion processes are the heaviest ones, and thus the richest in metals.

Gasification/partial oxidation results in syngas production that will advantageously generate hydrogen to partially feed the highly hydrogen-consuming hydroconversion process. Hydrocarbon load (slurry flakes) is burnt in dedicated furnaces in the presence of water and oxygen at ca. 1300° C. to produce hydrogen and carbon monoxide.

Advantageously, hydrogen produced by the method of valorization of the invention may be used for hydroconversion of the metal containing hydrocarbon feedstock, preferably for hydroconversion of the metal containing hydrocarbon feedstock in slurry reactors.

Consumption of hydrogen within the slurry process can go up to 3-4% wt relative to the feedstock (and more if combined with fixed bed hydrotreatment), depending on treated feedstock and performances target.

The gasification/POX unit can be dedicated to the slurry hydroconversion process or shared with an existing unit (co-feeding).

Commercial POX units running on liquid feedstock (ex: straight run vacuum residues, visbroken vacuum residues) can manage solids mixed together with the feedstock (or solved in the feedstock). For example, soot in a VVR dedicated POX unit can be coprocessed up to 1.5% wt.

Advantageously, the metal containing residue produced by the method of treatment of the invention will be recycled, preferably to recover the metals contained therein, for example to produce fresh metal containing catalyst.

A POX unit that is converting 50677 kg/h feedstock stream containing 1.3% wt soot produces ca. 677 kg/h of metal residue.

The metal containing catalyst and the metal contained in the metal containing hydrocarbon feedstock may each be independently selected among aluminum, tin, transition metals and combinations thereof.

Preferably, the metal contained in the metal containing catalyst is selected among aluminum, iron, molybdenum, tungsten, nickel, cobalt and their combinations.

Preferably, the metal contained in the metal containing hydrocarbon feedstock is selected among vanadium, nickel, cobalt, iron, and combinations thereof.

Flakes have high viscosities. In order to improve their pumpability at the outlet of the slurry hydroconversion process, they can be mixed with a coprocessing feed and sent to gasification. In case of a dedicated POX unit running on pure flakes, the latter can be diluted with a solvent (e.g. toluene) for transport. Solvent would then be removed by evaporation before gasification. According to a preferred embodiment, flakes are diluted with small amount of slurry feedstock.

A method of recycling of metals, preferably molybdenum, vanadium and nickel, contained in a spent catalyst and/or a metal containing hydrocarbon feedstock, can also be performed, wherein said spent catalyst and/or metal containing hydrocarbon feedstock successively undergoes (i) calcination to remove carbon containing material, (ii) washing with water, (iii) acidification with sulfuric acid to obtain an acidic water and a first precipitate which is separated, (iv) alkalinization of said acidic water with sodium hydroxide to obtain an alkaline water and a second precipitate which is separated.

Preferably, said calcination is performed so as to collect carbon monoxide and hydrogen.

Advantageously, ($FeCl(SO_4)$) is added at steps (iii) and (iv).

Preferably, the method for recycling undergoes a further step (v) wherein alkaline water is further neutralized with an acid.

Vanadium pentoxide ($V_2O_5$) and iron-molybdenum-nickel alloy can be obtained by introduction of first and/or second precipitate of steps (iii) (iv) into melted iron.

An embodiment of this recycling method is detailed below.

After being cooled at the outlet of the gasification reactors, the resulting raw gas is scrubbed with circulating water to remove the soot. A soot treatment unit extracts the soot, which are recycled (co-feed or solvent) from the waste water.

The waste water stream contains all the metals and heavy metals particles, such as Vanadium, Nickel, Sulfur, oxidizable substances and the catalytic metals.

Waste water undergoes a two step chemical demetallizing treatment of reaction-precipitation-separation, respectively at acidic and alkaline pH with addition of flocculation additives. A mixed V/Ni-sludge optionally containing catalytic metals is recovered in a sludge buffer tank. The sludge is then dewatered to residual moisture of 25-35% by mean of a filtration to obtain a cake. Such a waste water processing method is described below in details with respect to FIG. 5.

Resulting cake is further dried if pyrometallurgical metal recycling is chosen. In this case, cakes are loaded into molten iron to obtain reduced iron-molybdenum-nickel alloy that is valuable to steel manufacturers, and an upper layer constituted of divanadium pentoxyde ($V_2O_5$) which is removed. $V_2O_5$ can be processed using standard metallurgy to obtain vanadium-iron alloys or pure vanadium, depending on refining method and expected product specification.

Hydrometallurgical and electrochemical methods may also be useful for the isolation of metal constituents of the cake. Methods described by M. Marafi and A. Stanislaus in *Resources, Conservation and Recycling* 53 (2008), 1-26 and references cited therein are suitable for this purpose. The aforesaid document and references cited therein are hereby incorporated by reference.

Molybdenum and nickel, or molybdenum and vanadium may be used as sulfides for slurry hydroconversion. These combinations may have advantages in term of e.g. desulfuration or arsenic removal within the slurry process, depending on the feedstock. In this respect, one can use crude cakes and remove only one of nickel and vanadium and make an adjustment in the remaining element, namely molybdenum Pure Molybdenum oxide, iron oxide or tungsten oxide may be used for the preparation of the slurry catalyst. Alternatively, other Mo, Fe or W sources may be used which would enhance solubility of metal species in liquid hydrocarbon media such as crude oil. For instance, dicyclopentadienyl iron or dicyclopentadienyl molybdenum dichloride is suitable for the preparation of finely dispersed iron sulfide or molybdenum sulfide.

Usually, soluble metal species are sulfided using elemental sulfur or $H_2S$ or any suitable sulfur source such as dimethyldisulfide (DMDS), diethyldisulfide (DEDS) or a mercaptide such as methyl mercaptan or ethyl mercaptan.

Advantageously, catalysts may be prepared using $H_2S$ containing gas issued from a refinery stream such as (i) fuel gas or (ii) $H_2S$ rich gas which is dedicated to the feeding of sulfur recovery units (SRU) (e.g. Claus units).

In any case, it is desired that sulfidation of homogenous metal species in organic or aqueous media results in finely divided metal sulfide particles with a defined granulometry. Granulometry can be adjusted by varying stirring, reaction vessel temperature and sulfidation reactant or metal species introduction rate.

In case of ore catalyst (e.g. $MoS_2$=molybdenite), granulometry is comprised between 10 to 500 microns, preferably 100 to 200 microns. Concentration is up to 1% wt when slurry reactor is in operation.

In case of liposoluble or hydrosoluble precursor (e.g. dicyclopentadienyl molybdenum dichloride or dicyclopentadienyl iron), concentration of respectively prepared molybdenum sulfide ($MoS_2$) and iron sulfide (FeS) in the slurry reactor in operation is up to 1000 ppm, preferably between 100 and 300 ppm.

EXAMPLES OF POX CAKE COMPOSITIONS THAT ARE GENERATED

Example 1

Ural visbroken vacuum residue (V: 212 ppm and Ni: 71 ppm). Average cake composition after gasification in a POX plant: 25-35% wt Vanadium, 8-15% wt Nickel, 10-22% wt Iron, organic phase plus organic matter 30-55% (water 20-35% wt).

Slurry hydroconversion of above-mentioned Ural visbroken residue with 200 ppm Mo plus gasification leads to the average cake composition:

21-30% wt Molybdenum, 23-32% wt Vanadium, 7-14% Nickel, 9-20% Iron, organic phase plus organic matter 9-32% (water 18-32%)

Example 2

On Ural visbroken vacuum residue, slurry hydroconversion with 350 ppm Mo, 50 ppm V plus gasification leads to an average cake composition: 25-35% wt Molybdenum, 15-21% wt Vanadium, 5-9% wt Nickel, 6-13% wt Iron, organic phase plus organic matter 6-21% wt (water 12-21% wt).

Example 3

On average vacuum residue (V content: 20 to 400 ppm, Ni: 5 to 150 ppm), slurry hydroconversion with 200 ppm Mo plus gasification leads to the average cake composition:

27-38% wt Molybdenum, 2-43% wt Vanadium, 7-27% wt Nickel, 7-14% wt Iron, organic phase plus organic matter 7-23% wt (water 13-23% wt).

Slurry units can be operated with different kind of feedstock: atmospheric and vacuum residues, pitch coming from deasphalting, deasphalted oil, visbroken effluents (thermal cracking), shale oils, biomass ex-pyrolysis and ex-hydrothermal treatment, coal and, at least theoretically, petcoke from delayed coker.

Other feedstocks can also be coprocessed together with petroleum residue: tires, polymers, road bitumen.

Feedstock Characteristics:

Shale oils are impurities rich. Typical shale oil has the following average characteristics:

TABLE 1a

Shale oil typical characteristics

| Characteristic | Observed value | Unit |
|---|---|---|
| gravity | 900-1076 | $kg/m^3$ |
| °API | 7.9-25 | |

TABLE 1a-continued

| Shale oil typical characteristics | | |
|---|---|---|
| Characteristic | Observed value | Unit |
| C | 78-86 | % wt |
| H | 7.5-12 | % wt |
| H/C | 1.2-1.7 | Atomic ratio |
| O | 0.7-7.5 | % wt |
| S | 0.5-7.5 | |
| N | 0.1-2.5 | % wt |
| Arsine | 5.6-50 | ppm |
| Antimony Sb | | |
| Olefins (Bromine number) | 20-1260 | $gBr_2$/100 g |

TABLE 1b

| Shale oil typical Simulated Distillation<br>Example of typical Simulated Distillation: | | |
|---|---|---|
| IP | 80 | ° C. |
| 10% wt | 200 | ° C. |
| 20% wt | 250 | ° C. |
| 50% wt | 400 | ° C. |
| 70% wt | 450 | ° C. |
| 90% wt | 560 | ° C. |

Simulated Distillation Method:

Hydrocarbons are introduced in a gas chromatography column and are separated according to their boiling point and affinity with the stationary phase. Column temperature is increased. Boiling points are deducted from a calibrating curve, obtained in the same operating conditions with a known hydrocarbon mixture.

The column used is a Simdis HT 750 from Analytical Controls; length=5 m; Film=0.09 μm; Internal Diameter=0.53 mm (AC part no.: 24001.065). As calibration mixture the following may be used:

1. A C5-C28 mixture from Analytical Controls (AC part no.: 59.50.101A),
2. A C30-C120 mixture from Analytical Controls (Ac part no.: 59.50.100B).

IP means Initial distillation Point: temperature corresponding to a curve area of 0.5% of full chromatogram area.

FP means Final distillation Point: temperature corresponding to a curve area of 99.5% of full chromatogram area.

Shale oil contains some impurities which are catalysts poisons such as Arsine ($AsH_3$). Arsine is the worst poison of hydroprocessing catalyst (NiMo, CoMo). Alternative processes for shale oil refining are hampered by the presence of arsine, which poisons their catalytic functions. During hydrotreatment, arsine is deposed on the catalyst and trapped as nickel arsenide. Preferably, fresh catalyst is continuously added so that catalyst poisoning does not impact slurry hydroprocessing performances or the effluent qualities.

TABLE 2a

| typical characteristics of Atmospheric and Vacuum residues | | |
|---|---|---|
| Characteristic | Observed value | Unit |
| gravity | 995-1030 | kg/m$^3$ |
| °API | 10.7; 5.8 | |
| C | 82-85 | % wt |
| H | 9-14 | % wt |
| H/C | 1.3-2 | Atomic ratio |
| S | 0.3-4 | % wt |
| Ni | 1-94 | ppm |

TABLE 2a-continued

| typical characteristics of Atmospheric and Vacuum residues | | |
|---|---|---|
| Characteristic | Observed value | Unit |
| V | 5-448 | ppm |
| Asphaltenes $C_7$ (ASTM D6560) | 2-20 | % wt |

TABLE 2b

| typical simulated distillation of Atmospheric and Vacuum residues<br>Example of typical Simulated Distillation: | | |
|---|---|---|
| IP | 433 | ° C. |
| 10% wt | 544 | ° C. |
| 20% wt | 576 | ° C. |
| 50% wt | 636 | ° C. |
| 70% wt | 688 | ° C. |
| FP 88% wt | 748 | ° C. |

TABLE 3a

| typical characteristics of Pitch | | |
|---|---|---|
| Characteristic | Observed value | Unit |
| Deasphalting solvent | $C_3$ to $C_5$ | — |
| Gravity | 1.1-1.2 to solid | t/m$^3$ |
| Conradson Carbon | 50 | % wt |
| Sulfur | 6.5 | % wt |

TABLE 3b

| typical Simulated Distillation of Pitch<br>Example of typical Simulated Distillation: | | |
|---|---|---|
| 1% wt | 222 | ° C. |
| 10% wt | 310 | ° C. |
| 30% wt | 590 | ° C. |
| 50% wt | 682 | ° C. |
| FP 57% wt | 740 | ° C. |

TABLE 4a

| typical characteristics of Deasphalted oil | | |
|---|---|---|
| Characteristic | Observed value | Unit |
| Deasphalting solvent | $C_3$ to $C_5$ | — |
| Gravity | 0.970-1.025 | t/m$^3$ |
| Conradson Carbon | 7-22 | % wt |
| Sulfur | 1-5 | % wt |
| Asphaltenes $C_7$ | <0.05-3 | % wt |

TABLE 4b

| typical Simulated Distillation of Deasphalted oil<br>Example of typical Simulated Distillation: | | |
|---|---|---|
| IP | 371 | ° C. |
| 10% wt | 513 | ° C. |
| 20% wt | 543 | ° C. |
| 50% wt | 603 | ° C. |
| 70% wt | 643 | ° C. |
| FP 95% wt | 741 | ° C. |

TABLE 5a

| typical characteristics of Visbroken residue: | | |
|---|---|---|
| Characteristic | Observed value | Unit |
| Gravity | 995-1080 | $kg/m^3$ |
| Conradson Carbon | 22-33 | % wt |

TABLE 5b

| typical Simulated Distillation of Visbroken residue: Example of typical Simulated Distillation: | | |
|---|---|---|
| IP | 384 | ° C. |
| 10% wt | 496 | ° C. |
| 20% wt | 536 | ° C. |
| 50% wt | 613 | ° C. |
| 70% wt | 680 | ° C. |
| FP 82% wt | 748 | ° C. |

TABLE 6

| typical characteristics of Polymers: | | |
|---|---|---|
| Elemental composition (dry basis) | Observed value | unit |
| C | 40-96 | % wt |
| H | 3-4 | % wt |
| H/C | 0.38-1.20 | Atomic ratio |
| O | 0-50 | % wt |

TABLE 7

| typical characteristics of Petcoke: | | |
|---|---|---|
| Elemental composition (dry basis) | Observed value | unit |
| C | 86-88 | % wt |
| H | 3-4 | % wt |
| H/C | 0.41-0.56 | Atomic ratio |
| N | 1 | % wt |
| S | 7.5 | % wt |
| Ni + V | 750 | ppm |

TABLE 8

| typical characteristics of Pyrolysis Bio-oil | | |
|---|---|---|
| Characteristic | Observed value | Unit |
| Moisture content | 15-30 | % wt |
| Elemental composition (dry basis): | | |
| C | 54-58 | % wt |
| H | 5-8 | % wt |
| H/C | 1.03-1.78 | Atomic ratio |
| N | 0-0.2 | % wt |
| O | 35-40 | % wt |
| Solids | 0.2-1 | % wt |

TABLE 9

| typical characteristics of Slurry from pyrolysis bio-oil, usually sent to gasification | | |
|---|---|---|
| Characteristic | Observed value | Unit |
| Moisture content | 9-18 | % wt |
| Elemental composition (dry basis): | | |
| C | 72-75 | % wt |
| H | 3-5 | % wt |
| H/C | 0.48-0.83 | Atomic ratio |
| O | 20-25 | % wt |
| Coke particles | 40 | % wt |

TABLE 10

| typical characteristics of Bio-oil ex hydrothermal conversion: | | |
|---|---|---|
| Characteristic | Observed value | Unit |
| Moisture content | 9 | % wt |
| Elemental composition (dry basis): | | |
| C | 73.7 | % wt |
| H | 7.6 | % wt |
| H/C | 1.24 | Atomic ratio |
| O | 15.3 | % wt |
| N | 3.3 | % wt |

A slurry pilot characteristics and operation is now described:

A heavy feedstock, e.g. vacuum residue, is heated in order to reduce its viscosity, mixed with hydrogen-rich gas (preferably hydrogen deprived of contaminants which may impair activity of catalysts), and with a dispersed catalyst.

The dispersed catalyst is prepared within the slurry pilot unit by activation of a catalytic precursor in a stirred vessel, according to the following procedure. The catalytic precursor is injected into the stirred vessel, eventually with a solvent and/or a dispersant, together with a sulfiding agent. The mixture can be heated under optionally programmable operating conditions (temperature, pressure, concentration of sulfidation agent, residence time) depending on the sulfiding agent and catalytic precursor.

The slurry unit is equipped with two such stirred vessels so that while catalyst is prepared in one vessel, the content of the other vessel feeds the pilot.

Feedstock, catalyst and hydrogen are mixed together and sent to the reaction section. This section contains at least one, preferably two or more reactors. Using several reactors allows the use of different reaction conditions and catalysts, depending on the feedstock to be treated and final product specifications expectations.

Effluents are fractionated using separators, strippers, filters and a vacuum column.

The unit can recycle remaining atmospheric or vacuum residue.

Applied operating conditions can reach up to 200 bars and 480° C. in the reactor.

A conventional slurry plant can be designed according to U.S. Pat. No. 6,190,542.

An improved slurry pilot plant as well as its operation is now described with reference to appended FIGS. 1-5, which depict non-limitative units for upgrading a heavy feedstock and for recycling metals contained in a metal containing residue issued there from.

Figure 1:
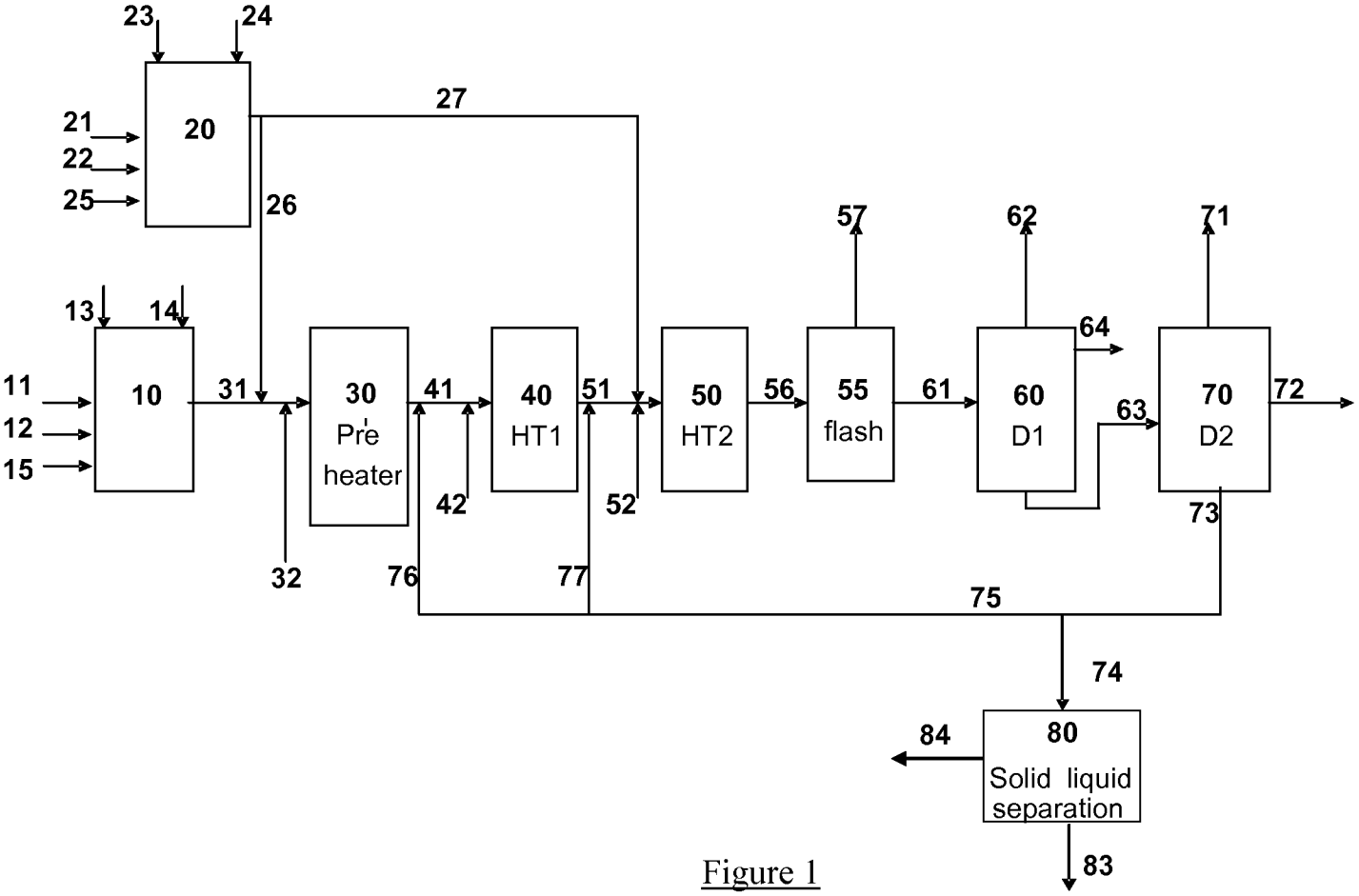
FIG. 1 is a schematic representation of a slurry pilot that includes separation of flakes and filtrate and combined flakes and filtrate flow recycle.

A feedstock is processed according to three main sections: additive and feedstock preparation 10, 20, reaction 40, 50, and separation 55, 60, 70. Additional optional solid-liquid separation 80 may be added. Each section can be made of different parts:

1—Additives and feedstock preparation: precursor activation, hydrogen, catalyst and feedstock mixture, heating.

2—Reaction: one or more reactors in series (preferably up to 3) for e.g. removal of sulfur, nitrogen, oxygen, and optionally arsine and phosphorus.

3—Separation: separators, atmospheric fractionation D1, 60, vacuum fractionation D2, 70, filtration 80, heat exchange 30.

1—Additives and Feedstock Preparation:

The catalytic additive is added at different concentrations, depending on its properties (reactivity, specificity, operating conditions (temperature, pressure) . . . ).

Sulfided metals active for hydroconversion are added at concentrations between 10 to 100000 ppm, preferably from 100 to 10000 ppm, more preferably from 200 to 1000 ppm.

Metals active for hydroconversion are transition metals and tin. Preferred metals are selected among Mo, Ni, Co, W, Cr, V, Fe, Sn and combinations thereof.

The catalytic precursor can be handled as water soluble, oil soluble or finely powdered solid, depending on forthcoming sulfidation conditions.

Sulfidation can be performed using a sulfiding agent 15, 25, (such as DMDS), $H_2S$ or the sulfur contained in the feed.

In order to improve additive dispersion and to limit foaming, crushed solids or other additives (14, 24) can be added (e.g. crushed coke 2% wt, granulometry 300 to 500 microns; alumina; thiosilicates; sulfonates or calcium carbonate; as well as any other suitable additive as those described in U.S. Pat. No. 5,954,945.

Liquid hydrocarbon (Streams 11, 21) (solvent, feedstock to treat, distillate . . . ) can be mixed with these additives under appropriate concentrations depending on the type of additive.

Hydrogen or hydrogen-rich gas or a mixture of hydrogen and $H_2S$ 12, 22 is added at the appropriate flows. Part of the hydrogen-rich gas 22 is injected upstream of the preheater 30 together with the feed, in order to limit furnace coking. Remaining $H_2$ is added upstream of the first reaction section 42, and possibly of the second reaction section 52.

Catalytic additive activation can be achieved in dedicated vessels 10, 20.

Catalyst additive activation conditions differ depending on the catalytic additive type and feedstock composition to treat 11, 21: temperature (including sometimes stages), pressure, sulfiding agent ratio 15, 25, stirring.

Two (or more) vessels 10, 20 can be arranged in parallel, so that two different catalytic additives can be activated. That way, hydro conversion can benefit the synergy effect of different catalytic additives. To the extent the reactions conditions are close (optimal temperature, pressure (hydrogen, other gases), optionally reaction time), two different catalysts may be added in the same reactor 40, 50. If reaction times differ from a catalyst to another, their concentration in the same reactor may be adapted accordingly. In the present scheme 2, catalytic additive issued from vessel 20 can be introduced upfront the preheater 30 via feeding line 26.

If operating conditions widely differ, it is preferred that different catalytic additives are added in separate reactors 40, 50. Extra reactors are added on purpose when supplemental different catalysts or reaction conditions are needed.

Catalytic additive issued from vessel 20 may also be added directly into separate reactor 50 via feeding line 27. Feeding line 27 can be equipped with preheating section (not represented on the figures).

2—Reaction

Additive mixed feedstock 31 and feedstock 32 are blended and sent to preheater 30. Preheated stream 41 is mixed with required hydrogen 42.

Feedstock and optional supplemental hydrogen-rich gas 42 are pressurized and enter the hydroprocessing reaction section.

Hydroprocessing is preformed in hydrotreatment (HT) reactors (HT1 40, HT2 50) in slurry phase.

The hydroprocessing stage HT1 40 is preferably maintained at a temperature from 360 to 480° C., preferably from 400 to 440° C., and under a pressure of 50 to 300 bar, preferably from 100 to 200 bar.

The reactor can operate in upflow or down flow stream.

Effluents 51 are possibly sent in a second reactor 50. When required, effluents 51 can be sent together with catalytic additive 27, and/or 31 (not represented on FIG. 2) and additional hydrogen or hydrogen-rich gas or a mixture of hydrogen and $H_2S$ 52 in order to compensate hydrogen consumption in HT1 or increase hydrogen deck.

The hydroprocessing stage HT2 50 is preferably maintained at a temperature from 360 to 480° C., preferably from 380 to 440° C., and under a pressure 50 to 300 bar, preferably from 100 to 200 bar.

The reactor can operate in upflow or down flow reactor.

Separation

This section is characterized by sending the liquid effluent 51 or 56 to atmospheric fractionation, followed by vacuum fractionation.

At the reactor outlet, effluents 51 or 56 are flashed in a dedicated vessel 55 in order to remove gases 57. Liquid effluent 61 is collected and sent to atmospheric fractionation D1 60.

Gases 57 contain hydrocarbons, $H_2$ and $H_2S$. After hydrocarbons removal, the $H_2$ and $H_2S$-containing stream can be recycled (position of streams 12-15 and 22-25: $H_2$ for process consumption and $H_2S$ for catalytic precursor activation.

Atmospheric fractionation 60 can be performed using conventional distillation column or thin film evaporation technologies.

Atmospheric fractionation overheads 62, 64 are condensed and recovered, and valorized as a conventional atmospheric distillate.

Atmospheric fractionation bottom 63 is sent to a vacuum fractionation 70.

As an option, atmospheric fractionation bottom can be recycled upstream reactors 1 and 2 as stream 75.

Vacuum fractionation 70 can be performed using conventional distillation column or by thin film evaporator technologies.

Vacuum fractionation overheads 71, 72 are condensed, recovered and valorized as a conventional vacuum distillate.

Vacuum fractionation bottom 73 is sent to purge 74, to recycle 75 or to additional treatment such as solid-liquid separation 80, where solids 83 are separated from remaining residues 84.

Remaining vacuum bottoms 73 can be purged 74 or partially recycled back to first section 40 (stream 76) or to second section 50 (stream 77) hydroconversion section (recycle rate from 0 to 100%).

The recycle in second section 50 can be an advantage, as milder operating conditions or other catalysts are used. Obviously, remaining vacuum bottom 73, which already passed through the reaction section, might be more difficult (specific) to hydroconvert.

Separation Option:

The second (or more) reactor 50 can be placed after the atmospheric fractionation 60. In this case, reactor 50 is fed with stream 63 and feeds 70 with stream 56. That way, only atmospheric residue 63 enters the second reactor HT2 50. This second reactor can be processed under different operating conditions (milder temperature, specific catalyst vessel 20).

Solids Recovery:

Remaining vacuum bottoms to recycle 73-77 contain solids (catalyst, ore, coke, sediments). These solids may contribute to plugging during operation and to material deterioration.

These solids, including catalyst, additive, or sediments/coke, can be removed using a liquid/solid separation.

Different separations can be used: filters, membranes or centrifuges or equivalent.

Filters size depend on the catalyst 13, 23 and added additive 14, 24.

The solid-liquid separation difficulties come from the fact that the remaining vacuum residue 73 (called flakes) is viscous and has a density close to the solids to remove.

Membranes and filters may be subject to plugging. Centrifuges efficiency increases with density differential between the two elements to separate.

Liquid out separation 84 is essentially deprived of solids or at least poorer in solids depending on separation efficiency (e.g. filter porosity).

Solids are recovered on stream 83. These solids are later sent to POX unit for hydrogen production and metals recycling or to any other suitable retreatment unit (e.g. kiln) in view of metal recycling.

Figure 3:
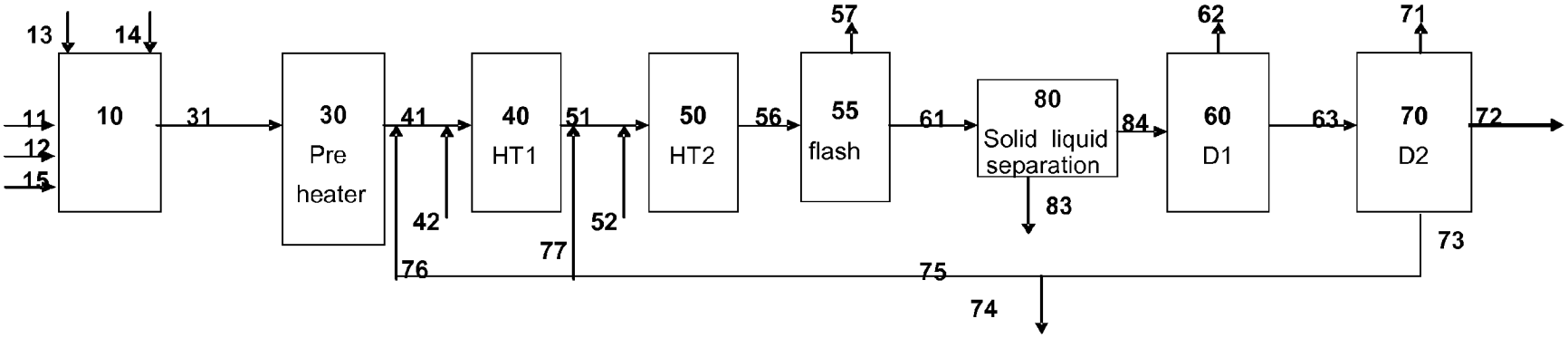
FIG. 3 is a schematic representation of a slurry pilot comprising a solid-liquid separation in a second position.
Figure 4:
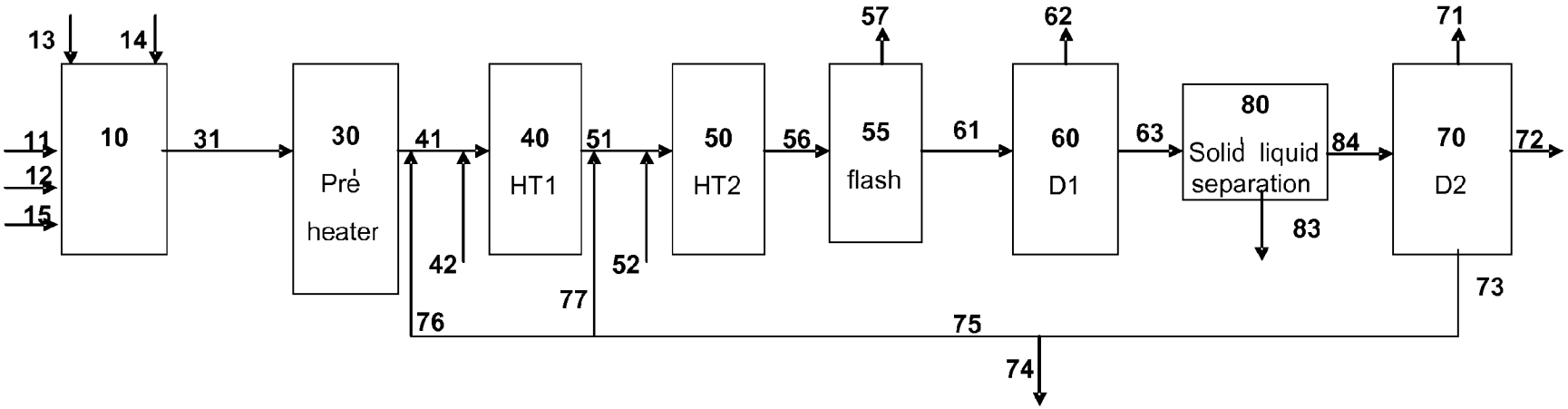
FIG. 4 is a schematic representation of a slurry pilot comprising a solid-liquid separation in a third position.

Solid-liquid separation issues can be managed by:

(1) the recycle of vacuum residue 73 at the inlet of reactor 40 and/or 50 (FIG. 1) without filtration (correspond to FIG. 1, in which flows 83, 84 and solid-liquid separation 80 have been suppressed) and with partial or full flow 74 draining out (FIG. 1, as shown);

(2) the use of centrifuge separation techniques, especially centrifuge filtration, irrespective of separation position;

(3) the use of two filters with different porosities so as to discriminate between catalyst and residues;

(4) the selection of the appropriate position of this solid-liquid separation 80 (FIGS. 2-4):

- Placed downstream of the vacuum fractionation: vacuum residue filtration, producing flakes (FIG. 2, Solid-liquid separation position 1).
- Placed upstream of the atmospheric fractionation, on flashed effluent, the filtration is performed with a less viscous and less dense liquid fraction (FIG. 3, Solid-liquid separation position 2).
- Upstream of the vacuum fractionation: atmospheric residue filtration (FIG. 4, Solid-liquid separation position 3). In this case, we can benefit from the high pressure differential between atmospheric and vacuum distillation towers.

Figure 2:
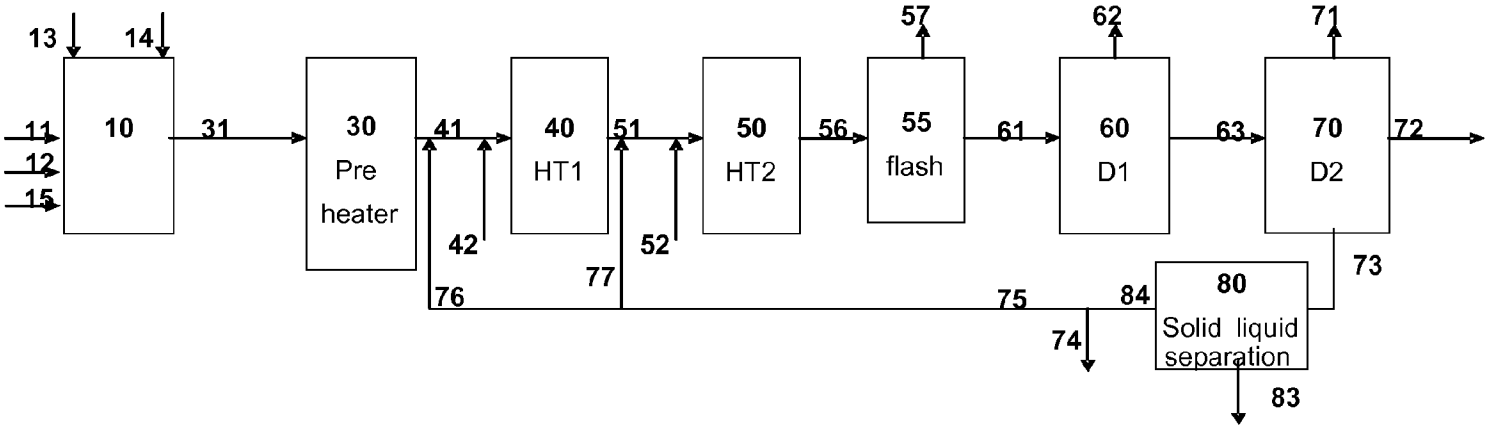
FIG. 2 is a schematic representation of a slurry pilot comprising a solid-liquid separation in a first position.

FIGS. 2-4 (same elements are represented using same reference numerals):

Solid-liquid separation position 1 (FIG. 2) shows a solid-liquid separation unit 80 positioned downstream vacuum distillation 70. Flakes 83 are separated from liquids 84 which can be either removed (flow 74) or recycled (flow 75). Recycle 75 may reenter the treatment line at first hydroconversion reactor 40 or at second hydroconversion reactor 50.

Solid-liquid separation position 2 (FIG. 3) shows a solid-liquid separation unit 80 positioned upstream atmospheric distillation 60. Flakes 83 are separated from liquids 84 which enter atmospheric distillation 60. Liquid flow 73 issued from the bottom of vacuum distillation 70 is either removed (flow 74) or recycled (flow 75). As above, recycle 75 may reenter the treatment line at first hydroconversion reactor 40 or at second hydroconversion reactor 50.

Solid-liquid separation position 3 (FIG. 4) shows a solid-liquid separation unit 80 positioned between atmospheric distillation 60 and vacuum distillation 70. Flakes 83 are separated from liquids 84 which enter vacuum distillation 70. Flow 73 issued from the bottom of vacuum distillation 70 is either removed (flow 74) or recycled (flow 75). As above, recycle 75 may reenter the treatment line at first hydroconversion reactor 40 or at second hydroconversion reactor 50.

Solids recovered on stream 83 will advantageously be treated in a POX unit, in which they are burnt at 1300° C. in the presence of water and oxygen to produce carbon monoxide, hydrogen and a metal containing residue.

This metal containing residue is collected and calcinated to remove carbon containing material. The resulting gas is scrubbed with circulating water to remove soot.

Figure 5:
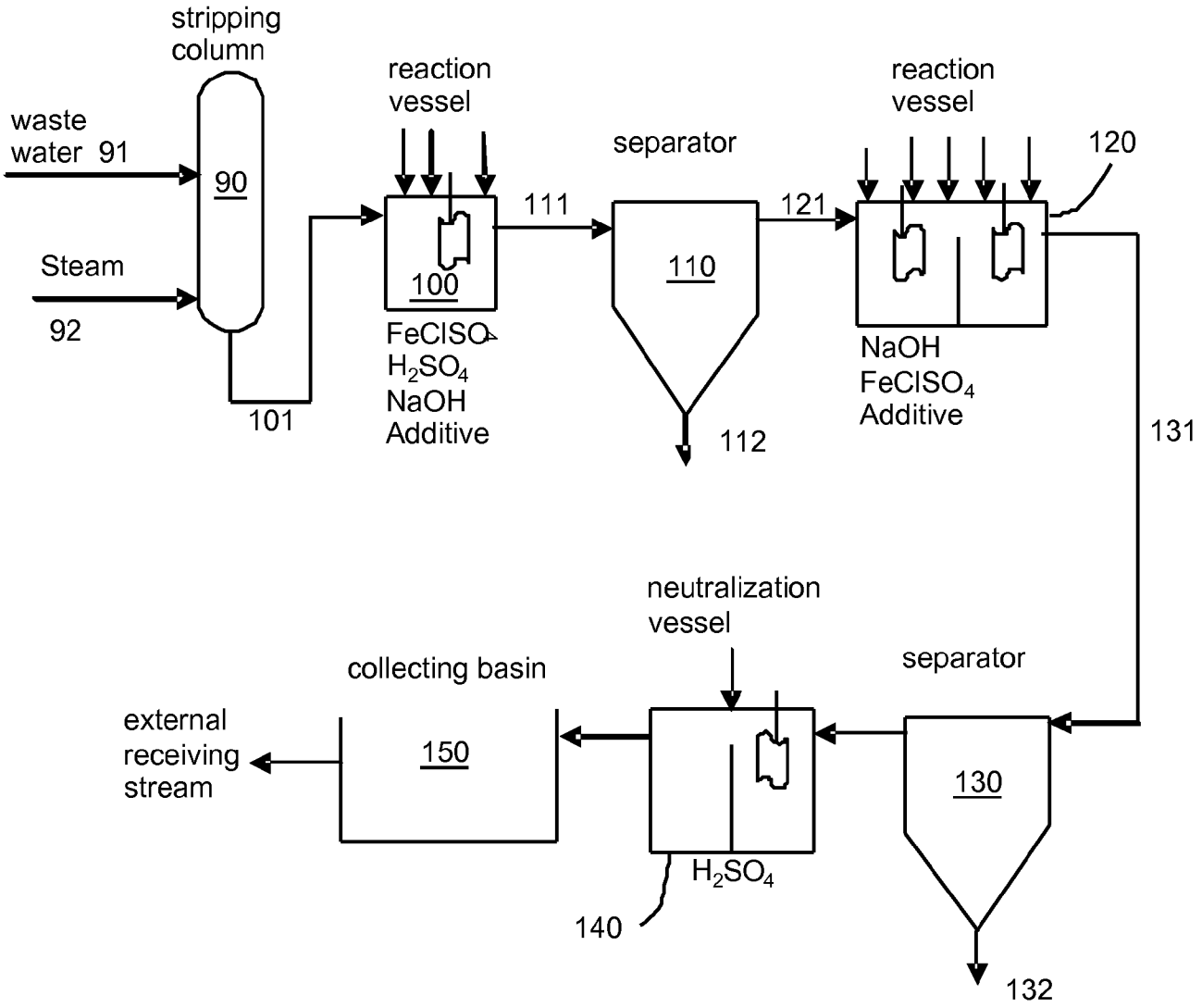
FIG. 5 represents a waste water treatment unit for recycling metals contained in waste waters issued from gasification/partial oxidation process of a metal containing residue issued from a slurry pilot as depicted in FIG. 1.

The waste water processing method is now described with respect to FIG. 5.

Waste water 91 is treated in a stripping column 90 for gas removal in presence of water vapor 92. The degasified water 101 is then conducted to a first stirred reaction vessel 100, within which are added an Iron(III) chlorosulphate $FeClSO_4$ solution at 40 wt %, sulphuric acid $H_2SO_4$ solution at 96 wt %, if necessary sodium hydroxide NaOH solution at 23 wt %, as well as polyelectrolyte solution.

The $FeClSO_4$ dosage is regulated such that 22 to 27 L/h is added to 80 to 120 $m^3$/h of waste water. The $H_2SO_4$-dosage is the major addition to ensure an acid pH-value. The pH-value is set between 4.5 and 5.5. A NaOH solution can be added if necessary to regulate the pH-value. About 300 to 400 mL of a polyelectrolyte solution per $m^3$ of waste water is added between the reaction vessel 100 and a clarifying thickener and separator 110 as flocculation additive to improve the capacity to sediment the solid matter that is formed. An example of flocculation additive (polyelectrolyte) includes a mixture of polymers, surfactants and silica.

The clarifying thickener and separator 110 (instrument: SEDIMAT-high duty clarifying thickener) allows separation of the solid matter. The solid matter sinks slowly to the vessel floor and thickens into sludge. The sludge flows to a sludge buffer tank, reservoir of the dewatering part of the process to obtain a first precipitate 112; whereas the remaining clarified water (acidic water 121) flows to a reaction vessel 120.

Within reaction vessel 120, some flocculation additive is added (0.5 to 2 L/h) and the addition of $FeClSO_4$ regulates the basic pH-value, between about 7.8 and 8.5 (the advantage of $FeClSO_4$ is to minimize the addition of NaOH). Similarly, some polyelectrolyte optimizes the flocculation. Here, the polyelectrolyte is a cationic flocculation additive that improves flocculation and precipitation, and thus the metal recovering.

The alkaline water 131 issued from reaction vessel 120 is conducted to a second separator 130 wherein a second precipitate 132 is recovered.

The separated clarified water (alkaline water 131) is further neutralized in a neutralization vessel 140 by $H_2SO_4$ addition and collected in a collecting basin 150 for recycling in the refinery or for further purification.

Precipitates 112 and 132 recovered from separators 110 and 112 are dewatered by filtration or any appropriate mean to obtain cakes. A filter press is a suitable mean for this aim. The residual moisture depends on the filter strainer cloth quality of the filter press, and is about 20 to 35 wt %. These cakes are further treated for metals recovering as explained above.

The invention claimed is:

1. A method for the separation of solids contained in a solid containing treated hydrocarbon feedstock issued from an industrial unit, wherein an ultimate reactor is fed with an ultimate catalyst, an ultimate hydrocarbon feedstock and an ultimate hydrogen containing gas, and wherein after reaction, the resulting ultimate treated hydrocarbon feedstock undergoes a liquid-solid filtration before a final fractionation is performed, wherein liquid-solid filtration separates the ultimate catalyst from the remaining solid residues contained in the ultimate treated hydrocarbon feedstock.

2. A method according claim 1, wherein, before reaction and before filtration, a penultimate hydrocarbon feedstock undergoes a penultimate treatment in a penultimate reactor fed with a penultimate catalyst and/or the ultimate catalyst, and a penultimate hydrogen containing gas, to obtain the ultimate hydrocarbon feedstock.

3. A method according to claim 1, wherein the final fractionation is a vacuum fractionation.

4. A method according to claim 1, wherein the final fractionation is a combination of an atmospheric fractionation followed by a vacuum fractionation.

5. A method according to claim 1, wherein the resulting ultimate treated hydrocarbon feedstock undergoes flash separation to remove gaseous species before the liquid-solid filtration.

6. A method according to claim 1, wherein the industrial unit is a slurry plant.

7. A method according to claim 1, wherein filtration is performed with at least two filters having different porosities so as to discriminate the catalyst from the remaining solid residues.

8. A method according to claim 1, wherein the ultimate catalyst is recycled.

9. A method according to claim 1, wherein the ultimate catalyst is reused.

10. A method according to claim 1, wherein the liquid-solid filtration is selected from among simple filtration, backwashed filtration and centrifuge filtration.

11. A method according to claim 10, wherein the liquid-solid filtration is centrifuge filtration.

12. A method of valorization of a metal containing hydrocarbon feedstock issued from an industrial unit using a metal containing catalyst, wherein spent metal containing catalyst and/or metal containing residual hydrocarbon feedstock are collected using a separation method according to claim 1, and treated to produce carbon monoxide, hydrogen and a metal containing residue.

13. A method according to claim 12, wherein hydrogen is used for hydroconversion of the metal containing hydrocarbon feedstock.

14. A method according to claim 12, wherein the metal containing residue is recycled to produce fresh metal containing catalyst.

15. A method for the separation of solids contained in a solid containing treated hydrocarbon feedstock issued from an industrial unit, wherein a reactor is fed with a catalyst, a hydrocarbon feedstock and a hydrogen containing gas, and wherein after reaction, the resulting treated hydrocarbon feedstock undergoes a liquid-solid filtration characterized in that filtration allows separating catalyst, liquid and remaining solids, wherein the liquid-solid filtration is performed with at least a first filter having a porosity sufficient to separate large particles of either the catalyst or other solids, and a second filter having a porosity sufficient to separate small particles of either the catalyst or other solids.

* * * * *